US009738946B2

(12) United States Patent
Hei et al.

(10) Patent No.: US 9,738,946 B2
(45) Date of Patent: Aug. 22, 2017

(54) METHOD FOR PRODUCING SILICON STEEL NORMALIZING SUBSTRATE

(75) Inventors: Hongxu Hei, Shanghai (CN); Xiao Chen, Shanghai (CN); Xiandong Liu, Shanghai (CN); Shishu Xie, Shanghai (CN); Dejun Su, Shanghai (CN); Runjie Lin, Shanghai (CN); Peili Zhang, Shanghai (CN); Rongqiang Jiang, Shanghai (CN); Miao Ye, Shanghai (CN)

(73) Assignee: Baoshan Iron & Steel, Co., Ltd., Shanghai (CN)

( * ) Notice: Subject to any disclaimer, the term of this patent is extended or adjusted under 35 U.S.C. 154(b) by 534 days.

(21) Appl. No.: 14/379,595

(22) PCT Filed: Mar. 27, 2012

(86) PCT No.: PCT/CN2012/000368
§ 371 (c)(1),
(2), (4) Date: Aug. 19, 2014

(87) PCT Pub. No.: WO2013/131212
PCT Pub. Date: Sep. 12, 2013

(65) Prior Publication Data

US 2015/0013846 A1 Jan. 15, 2015

(30) Foreign Application Priority Data

Mar. 8, 2012 (CN) ..... 2012 1 0060176

(51) Int. Cl.
*C21D 8/12* (2006.01)
*C21D 1/28* (2006.01)
(Continued)

(52) U.S. Cl.
CPC ..... *C21D 8/1261* (2013.01); *C21D 1/28* (2013.01); *C21D 1/34* (2013.01); *C21D 9/561* (2013.01); *H01F 41/00* (2013.01)

(58) Field of Classification Search
CPC ..... C21D 8/1261; C21D 9/561; C21D 1/34; C21D 1/28; H01F 41/00
(Continued)

(56) References Cited

U.S. PATENT DOCUMENTS 3,307,981 A * 3/1967 Katsahias ..... C21D 9/52 148/287
3,752,458 A * 8/1973 Tokuda ..... C21D 9/561 266/102
(Continued)

FOREIGN PATENT DOCUMENTS

CN 2471440 Y 1/2002
CN 101760607 A 6/2010
(Continued)

OTHER PUBLICATIONS

Machine translation of (CN101760607B) (no date available).*
(Continued)

*Primary Examiner* — Kiley Stoner
(74) *Attorney, Agent, or Firm* — Eversheds-Sutherland (US) LLP

(57) ABSTRACT

A method for producing a silicon steel normalizing substrate comprises steelmaking, hot rolling and normalizing steps. A normalizing furnace is used in the normalizing step, and along a moving direction of strip steel, the normalizing furnace sequentially comprises: a preheating section, a non-oxidizing heating section, a furnace throat, furnace sections for subsequent normalizing processing, and a delivery seal chamber. Furnace pressures of the normalizing furnace are distributed as follows: the furnace pressure of a downstream
(Continued)

furnace section adjacent to the furnace throat along the moving direction of the strip steel is the highest, the furnace pressure decreases gradually from the furnace section with the highest furnace pressure to a furnace section in an inlet direction of the normalizing furnace, and the furnace pressure decreases gradually from the furnace section with the highest furnace pressure to a furnace section in an outlet direction of the normalizing furnace.

8 Claims, 2 Drawing Sheets

(51) Int. Cl.
*C21D 1/34* (2006.01)
*H01F 41/00* (2006.01)
*C21D 9/56* (2006.01)

(58) Field of Classification Search
USPC ..... 148/110–112
See application file for complete search history.

(56) References Cited

U.S. PATENT DOCUMENTS 4,490,107 A * 12/1984 Kimura ..... F27B 9/3011 432/11
4,832,757 A * 5/1989 Cox ..... C21D 1/28 148/598
5,044,944 A * 9/1991 Furuya ..... F27B 9/028 432/128
6,608,290 B1 * 8/2003 Robinson ..... C21D 9/561 219/645
8,641,841 B2 * 2/2014 Tatsuoka ..... C21D 1/00 148/121
2013/0181039 A1 * 7/2013 Obata ..... C22C 38/002 228/194
2013/0305559 A1 * 11/2013 Hamman ..... C21D 9/561 34/487

FOREIGN PATENT DOCUMENTS

CN 101812571 A 8/2010
CN 102268516 A * 12/2011
CN 102268516 B * 5/2013
DE 2055964 A * 2/1977
EP 0175640 A2 * 3/1986 ..... C21D 9/561
FR WO 2008000945 A1 * 1/2008
JP 61073880 A * 4/1986 ..... C21D 9/561
JP 62-120427 A 6/1987
JP 2-149622 A 6/1990
JP 5-202419 A 6/1990
JP 2013167581 A * 8/2013

OTHER PUBLICATIONS

Machine translation of (CN101812571A) (no date available).*
PCT International Search Report for PCT Application No. PCT/CN2012/000368 mailed Dec. 20, 2012 (6 pages).

* cited by examiner

METHOD FOR PRODUCING SILICON STEEL NORMALIZING SUBSTRATE

CROSS REFERENCE TO RELATED APPLICATIONS

This application claims the priority benefit of PCT/CN2012/000368 filed on Mar. 27, 2012 and Chinese Application No. 201210060176.7 filed on Mar. 8, 2012. The contents of these applications are hereby incorporated by reference in their entirety.

FIELD OF THE INVENTION

The present invention relates to a method for producing high-quality normalized silicon steel substrates.

BACKGROUND OF THE INVENTION

The production of non-oriented electrical steel both at home and abroad has gradually entered into the era of excess capacity, and low-grade oriented silicon steel products have also stepped into the stage of saturation. In order to secure the products a place in the fierce competition in the market, it is of penetrating significance to continue to upgrade product quality, or continue to reduce production cost. Silicon steel production methods include steelmaking, hot rolling, normalizing, acid pickling, cold rolling and subsequent annealing. Non-oriented silicon steel is often subject to normalizing treatment for the purpose of obtaining a coarse grain structure for the hot rolled sheet before cold rolling, so as to achieve a high-strength 0 vw structure for the cold-rolled sheet upon annealing. Oriented silicon steel products are produced by adjusting the grain size and texture, realizing hard-phase control, generating free C and N, precipitating ALN and so on.

If the normalizing process is not properly controlled, that is, in the actual production process, if the mixture of the imperfectly mixed and combusted coal oven gas, air and smoke in the non-oxidation heater flows backward to the latter section of the tunnel seal, it will raise the dew point, cause the remaining oxygen to further react with strip steel and form on the substrate surface a layer of hardly removable dense oxides constituted of Si, Al, Mn, etc. These oxides adhering to the surface of the substrate will be extremely difficult to be removed in the subsequent shot blasting and acid pickling treatment. After cold rolling, dust like point and strip-shaped hand feeling-free matters will be found attached locally or entirely across its width on the surface of the rolled hard sheet.

Japan is a world leader in terms of silicon production technology level. For example, the Japanese Patent Publication SHO 48-19048 focused on how to strengthen the acid pickling treatment to remove the dense oxides already produced as much as possible. Domestic published literature, *Electrical Steel* edited by He Zhongzhi, also explores how to eliminate the oxides attached on the substrate surface. The specific descriptions are as follows: subject the annealed steel sheet to acid pickling treatment in concentrated hydrochloric acid containing 10% HF or 1~2% HF+6% $HNO_3$ at 70° C., or subject it to $H_3PO_4$+HF chemical polishing or electrolytic polishing; after complete removal of attached oxides, subject the substrate to subsequent treatment, and the iron loss of the finished silicon steel products will be significantly reduced.

The above literature all propose the strengthening of acid pickling treatment to remove dense oxides on the substrate surface in the steps following normalizing, but they are only follow-up remedial measures. There are usually such problems as complicated process and increased cost in subsequent steps after normalizing. Therefore, efforts are still expected to be made to prevent the formation of dense oxides in the normalizing treatment process.

SUMMARY OF THE INVENTION

The object of the present invention is to provide a method for producing high-quality normalized silicon steel substrates. "High quality" means that, after normalizing treatment by this method, no dense oxides which cannot be removed by subsequent acid pickling are produced on the substrate. The method of the present invention can successfully prevent the formation of dense oxides in the normalizing treatment process, and improve the quality of normalized silicon steel substrate. By the method of the present invention, the steps following normalizing are simplified and the cost is reduced.

The present invention provides a method for producing normalized silicon steel substrates, including steps of steelmaking, hot rolling and normalizing, wherein a normalizing furnace being used in the normalizing step and comprising sequentially, along the running direction of the strip steel, preheating section, non-oxidation heating section, tunnel seal, multiple subsequent normalizing treatment furnace sections and exit sealing device. The normalizing furnace has a pressure distribution as follows: the furnace pressure reaches its maximum at the downstream furnace section adjacent to the tunnel seal along the running direction of the strip steel, said furnace pressure gradually declines from the furnace section having the maximum pressure to the furnace sections toward the inlet of the normalizing furnace, and gradually declines from the furnace section having the maximum pressure to the furnace sections toward the outlet of the normalizing furnace.

In the method of the present invention, said multiple subsequent normalizing treatment furnace sections include at least one furnace section selected from radiant tube heating/cooling section, electric/radiant tube soaking section and radiant tube/water jacket cooling section, and said multiple subsequent normalizing treatment furnace sections are arranged in a random sequence.

In the method of the present invention, the protective gas of $N_2$ is charged into the furnace sections between tunnel seal and exit sealing device, and the supply of the protective gas of $N_2$ to the furnace sections between the tunnel seal and exit sealing device is adjusted so as to realize said distribution of furnace pressure.

In the method of the present invention, the supply of the protective gas of $N_2$ to said furnace sections satisfies the following relation:

$N_2$ supply at tunnel seal/total $N_2$ supply at multiple subsequent normalizing treatment furnace sections≥1.2.

In the method of the present invention, said distribution of furnace pressure has a furnace pressure difference controlled in the range from 0 to 10 Pa between the downstream furnace section adjacent to the tunnel seal along the running direction of the strip steel and the non-oxidation heating section, and preferably controlled in the range from 5 to 10 Pa.

In the method of the present invention, said distribution of furnace pressure has a benchmark for furnace pressure control set in the range from 10 to 25 Pa.

In the method of the present invention, in said distribution of furnace pressure, the slope of furnace pressure reduction from the downstream furnace section adjacent to the tunnel seal along the running direction of the strip steel to the furnace sections toward the outlet of the normalizing furnace is between −0.05 and −0.25, and the slope of furnace pressure reduction from the non-oxidation heating section to the furnace sections toward the inlet of the normalizing furnace is between 0.55 and 0.8.

The method of the present invention can successfully prevent the formation of dense oxides in the normalizing treatment process, and improve the quality of normalized silicon steel substrate. By the method of the present invention, the steps following normalizing are simplified and the cost is reduced.

DETAILED DESCRIPTION OF THE INVENTION

In conjunction with the following figures and embodiments, the method of the present invention is specifically described below, but the present invention is not limited thereto.

The production method of the normalized silicon steel substrate includes steps of steelmaking, hot rolling and normalizing, where a normalizing furnace being used in the normalizing step and comprising sequentially, along the running direction of the strip steel, preheating section, non-oxidation heating section, tunnel seal (furnace chamber height abruptly reduced), multiple subsequent normalizing treatment sections, and exit sealing device, wherein the multiple subsequent normalizing treatment furnace sections include at least one furnace section selected from radiant tube heating/cooling section, electric/radiant tube soaking section and radiant tube/water jacket cooling section, and said multiple subsequent normalizing treatment furnace sections are arranged in a random sequence. The heating before tunnel seal is non-oxidation heating by direct flame combustion, and the protective gas of $N_2$ is charged between tunnel seal and exit sealing device (including tunnel seal and exit sealing device). The functions of the normalizing furnace include preheating, heating, soaking and cooling.

Figure 1:
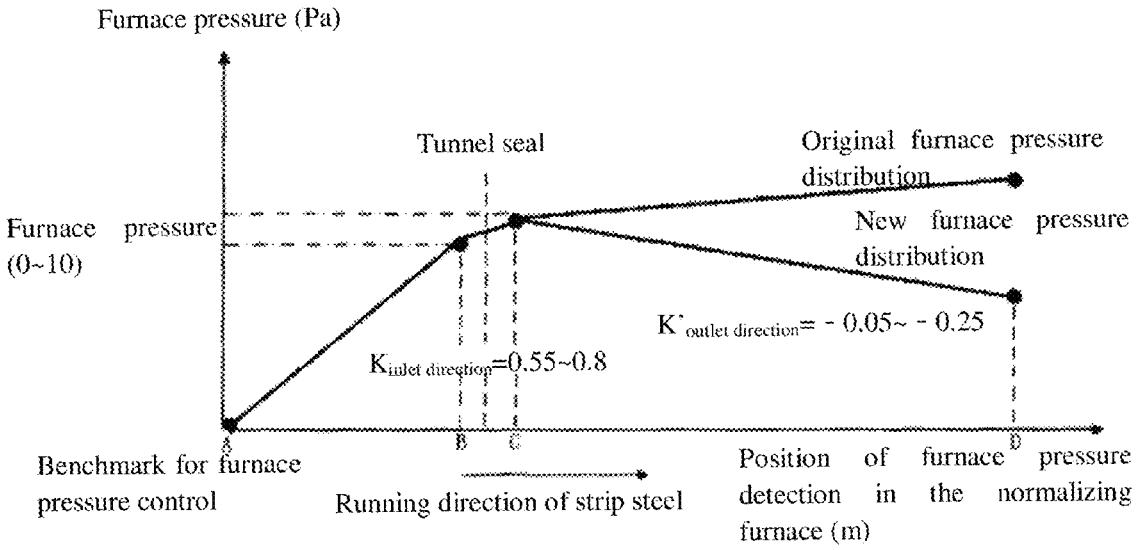
FIG. 1 provides the schematic diagram for comparison between the original furnace pressure distribution of the normalizing furnace and the new furnace pressure distribution in the present invention, in which A represents the preheating section, B represents the non-oxidation heating section, C represents the downstream section adjacent to the tunnel seal, and D represents the last furnace section among the multiple subsequent normalizing treatment sections.
Figure 2:
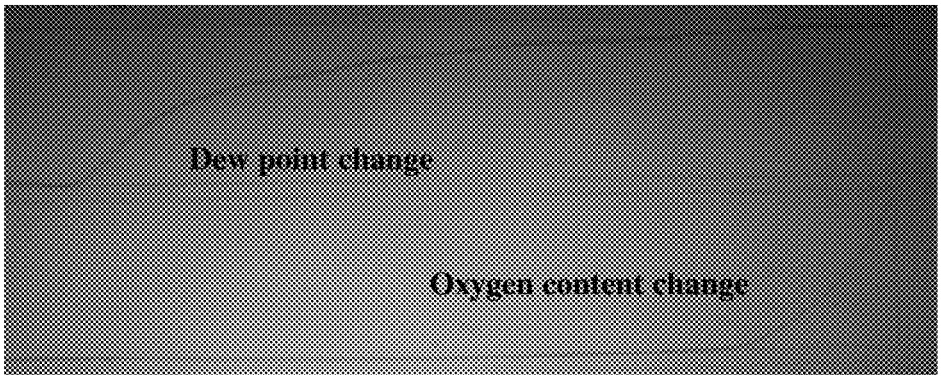
FIG. 2 provides the change tendency chart of both dew point and oxygen content detected in subsequent furnace sections of the tunnel seal of the normalizing furnace when the smoke of the non-oxidation heating section flows backward into the tunnel seal of the normalizing furnace.

Along the running direction of the strip steel, the furnace pressures of the preheating section, the non-oxidation heating section, the downstream furnace section adjacent to the tunnel seal and the last furnace section of multiple subsequent normalizing treatment furnace sections are detected and provided in FIG. 1. Furnace pressure refers to the internal pressure of the furnace chamber. The furnace pressure detected in the preheating section is referred as the benchmark for furnace pressure control.

The present invention, via a new type of furnace pressure distribution in the normalizing furnace shown in FIG. 1, eradicates the backward flow of smoke, prevents the production of dense oxides on the surface of the hot-rolled steel sheet in the course of subsequent normalizing treatment which cannot be effectively removed by acid pickling, and thus improves the quality of the normalized substrate. The weight percentages of the main elements of the hot-rolled steel sheet are described as below: $0.5 \leq Si \leq 6.5\%$, $0.05 \leq Mn \leq 0.55\%$, $0.05 \leq Al \leq 0.7\%$, $C \leq 0.05\%$, $P \leq 0.03\%$, $S \leq 0.03\%$. It also contains Fe and some unavoidable impurity elements. This is just a general chemical composition of the hot-rolled steel sheet, and the present invention is not limited thereto and can also include other chemical components.

In the original distribution of furnace pressure as shown in FIG. 1, the tunnel seal is rarely or only slightly supplemented with the protective gas of $N_2$ in the course of normal production. In the case of the change of product variety or specification, the conversion of technology or the change of threading speed during production, the combustion load will change as well. Particularly, in the course of transition strip production, the differences in the material, specification or usage frequency of the transition strip will cause wild fluctuation of furnace atmosphere and thus result in the backward flow of smoke of the non-oxidation heating furnace section to the latter furnace section of the tunnel seal. In this case, the imperfectly combusted and consumed air (containing oxygen in high volume) and smoke (containing gaseous $H_2O$) will react with the high-temperature strip steel, and gradually form dense oxides on the substrate surface.

The distribution of the new furnace pressure of the present invention as shown in FIG. 1 is described as below: the furnace pressure reaches its maximum at the downstream furnace section adjacent to the tunnel seal along the running direction of the strip steel, said furnace pressure gradually declines from the furnace section having the maximum pressure to the furnace sections toward the inlet of the normalizing furnace, and gradually declines from the furnace section having the maximum pressure to the furnace sections toward the outlet of the normalizing furnace. In the present invention, the protective gas of $N_2$ is charged into the furnace sections between tunnel seal and exit sealing device, and the supply of the protective gas of $N_2$ to the furnace sections between the tunnel seal and exit sealing device is adjusted so as to realize said distribution of furnace pressure. For example, it may be realized by adjusting the flow of the protective gas of $N_2$ in the tunnel seal and multiple subsequent normalizing treatment furnace sections. The specific practice is to charge a certain amount of the protective gas of $N_2$ into the tunnel seal, and thus form a protective curtain effectively cut off by $N_2$. In order to form an effective protective curtain of $N_2$, the amount of $N_2$ charged into the tunnel seal and that charged into multiple subsequent normalizing treatment furnace sections need to satisfy the following relation:

$N_2$ supply at tunnel seal/total $N_2$ supply at multiple subsequent normalizing treatment furnace sections $\geq 1.2$.

In order to form an effective protective curtain of $N_2$ and completely eradicate the backward flow of smoke, as shown in FIG. 1, said distribution of furnace pressure of the present invention has a furnace pressure difference controlled in the range from 0 to 10 Pa between the downstream furnace section adjacent to the tunnel seal along the running direction of the strip steel and the non-oxidation heating section, and preferably controlled in the range from 5 to 10 Pa.

The fuel supplied in the non-oxidation heating furnace combusts inside the furnace. Inside the furnace chamber of a certain volume, when the amount of exhaust produced by combustion and that emitted by the smoke exhaust fan are controlled at a balance point, the furnace pressure can be stably controlled around the benchmark for furnace pressure control. In order to realize the stable control of furnace pressure on the basis of energy conservation, said distribution of furnace pressure of the normalizing furnace of the present invention has a benchmark for furnace pressure control set in the range from 10 to 25 Pa. If the benchmark for furnace pressure control is less than 10 Pa, air will be taken in from the inlet sealed roller of the normalizing furnace in large amounts; if it is above 25 Pa, smoke will overflow out of the furnace chamber in large amounts, which not only causes significant heat loss but also poses a safety hazard to equipment nearby.

Based on various sizes of furnace body structure, the $N_2$ amount of the exit sealing device is regulated to adjust the slope $K'_{outlet\ direction}$ of furnace pressure reduction from the downstream furnace section adjacent to the tunnel seal along the running direction of the strip steel to the furnace sections toward the outlet of the normalizing furnace, i.e., the slope of furnace pressure reduction from the highest point to the outlet of the normalizing furnace.

$K'_{outlet\ direction}$=(furnace pressure of the last furnace section among the multiple subsequent normalizing treatment sections along the running direction of the strip steel−furnace pressure of the downstream furnace section adjacent to the tunnel seal along the running direction of the strip steel)/distance between the corresponding two furnace sections.

In order to ensure the furnace pressure distribution of the present invention and reduce the consumption of $N_2$ to the greatest extent, as shown in FIG. 1, in the new furnace pressure distribution of the present invention, the slope $K'_{outlet\ direction}$ of furnace pressure reduction from the downstream furnace section adjacent to the tunnel seal along the running direction of the strip steel to the furnace sections toward the outlet of the normalizing furnace is between −0.05 and −0.25.

In combination with smoke baffle and smoke exhaust fan, we can adjust the slope $K_{inlet\ direction}$ of furnace pressure reduction from the non-oxidation heating section to the furnace sections toward the inlet of the normalizing furnace, i.e. adjust the slope of furnace pressure reduction from the non-oxidation heating section to the benchmark for furnace pressure control as shown in FIG. 1.

$K_{inlet\ direction}$=(furnace pressure of the non-oxidation heating section−the benchmark for furnace pressure control)/distance between the corresponding two furnace sections As shown in FIG. 1, the slope $K_{inlet\ direction}$ of furnace pressure reduction from the non-oxidation heating section to the furnace sections toward the inlet of the normalizing furnace is between 0.55 and 0.8. If the slope is above 0.8, it will cause inadequate effective heat exchange between smoke and steel strip, raise smoke exhaust temperature and result in energy waste. If the slope is less than 0.55, gradient distribution of furnace pressure cannot be formed inside the furnace chamber, and air flow inside the furnace is not smooth, which will then affect the stable combustion at the nozzle of the non-oxidation heating furnace.

When the furnace pressure distribution inside the entire furnace chamber satisfies the above relation, the normalized substrate produced presents the best surface quality.

By the method of the present invention, by adjusting the recharge position and flow of the protective gas of $N_2$ of the normalizing furnace, a protective curtain effectively cut off by $N_2$ is formed in the tunnel seal, and by effectively controlling the slopes of furnace pressure reduction from the tunnel seal to the inlet and outlet, it can completely eradicate the backward flow of smoke, prevent the production of dense oxides on the surface of the hot-rolled steel sheet in the course of subsequent normalizing treatment which cannot be effectively removed by acid pickling, and thus improve the quality of the normalized substrate.

PREPARATION EXAMPLES

Hot rolled steel coil production methods include such steps as steelmaking and hot rolling, as described below:

1) Steelmaking process. It covers converter blowing, RH refining and continuous casting process. Through the above processes, we can strictly control the ingredients, inclusions and microstructure of the products, maintain unavoidable impurities and residual elements in the steel at a relatively low level, reduce the amount of inclusions in the steel and coarsen them, and try to obtain casting blanks of a high equiaxed crystal proportion at a rational cost through a series of steel-making technology and according to the different categories of products.

2) Hot-rolling process. It covers different steps like heating, rough rolling, finish rolling, laminar cooling and reeling at different temperatures with regard to the steel-grade continuous casting billets designed in Step 1. Relying on the hot rolling process independently developed by Baosteel, it can effectively save energy and obtain high-production and high-quality hot coils with excellent performance which can satisfy the performance and quality requirements on final products. The chemical components of the hot rolled steel coil prepared are described as below: $0.5 \le Si \le 6.5\%$, $0.05 \le Mn \le 0.55\%$, $0.05 \le Al \le 0.7\%$, $C \le 0.05\%$, $P \le 0.03\%$, $S \le 0.03\%$. It also contains Fe and some unavoidable impurity elements.

EXAMPLES

Constituted by C: 20 ppm, Si: 3.06%, Mn: 0.2%, AL: 0.58%, P: 0.004% and S<0.0005%, the hot rolled steel coil has gone through normalizing by various methods, and the quality of the product surface after acid pickling and cold rolling is described as below:

TABLE 1

Comparison between the Normalized Substrate Produced under Furnace Pressure Distribution of the Present Invention and That Produced after Backward Flow of Smoke

| | $N_2$ supply ratio[1] | Benchmark furnace pressure[2] | Furnace pressure after tunnel seal[3]-furnace pressure of non-oxidation heating section | $K_{inlet\ direction}$ | $K'_{outlet\ direction}$ | Oxide residue on normalized substrate after acid pickling |
|---|---|---|---|---|---|---|
| Example 1 | 1.3 | 20 | 5 | 0.70 | −0.1 | No |
| Example 2 | 1.35 | 15 | 7 | 0.80 | −0.15 | No |
| Comparative Example 1 | 1.15 | 20 | −5 | 0.45 | −0.15 | (Backward flow of smoke) Yes |

TABLE 1-continued

Comparison between the Normalized Substrate Produced under Furnace Pressure Distribution of the Present Invention and That Produced after Backward Flow of Smoke

| | $N_2$ supply ratio[1] | Benchmark furnace pressure[2] | Furnace pressure after tunnel seal[3]-furnace pressure of non-oxidation heating section | $K_{inlet\ direction}$ | $K'_{outlet\ direction}$ | Oxide residue on normalized substrate after acid pickling |
|---|---|---|---|---|---|---|
| Comparative Example 2 | 1.1 | 25 | −4 | 0.90 | −0.07 | (Backward flow of smoke) Yes |

Remark

[1]$N_2$ supply ratio refers to the ratio of $N_2$ supply at the tunnel seal ($Nm^3$/hr)/total $N_2$ supply at multiple subsequent normalizing treatment furnace sections ($Nm^3$/hr).

Remark

[2]Benchmark furnace pressure refers to the furnace pressure of the benchmark for furnace pressure control.

Remark

[3]Furnace pressure after tunnel seal refers to the furnace pressure of the downstream furnace section adjacent to the tunnel seal along the running direction of the strip steel.

In Example 1, the $N_2$ supply ratio (the ratio of $N_2$ supply at the tunnel seal ($Nm^3$/hr)/total $N_2$ supply at multiple subsequent normalizing treatment furnace sections ($Nm^3$/hr)) is set at 1.3. The furnace pressure difference between the downstream furnace section adjacent to the tunnel seal along the running direction of the strip steel and the non-oxidation heating section is 5 Pa. The slope $K'_{outlet\ direction}$ of furnace pressure reduction from the downstream furnace section adjacent to the tunnel seal along the running direction of the strip steel to the furnace sections toward the outlet of the normalizing furnace is −0.1; the slope $K_{inlet\ direction}$ of furnace pressure reduction from the non-oxidation heating section to the furnace sections toward the inlet of the normalizing furnace is 0.70. It can be seen from the above data that, the furnace pressure reaches its maximum at the downstream furnace section adjacent to the tunnel seal along the running direction of the strip steel, the furnace pressure gradually declines from the furnace section having the maximum pressure to the furnace sections toward the inlet of the normalizing furnace, and gradually declines from the furnace section having the maximum pressure to the furnace sections toward the outlet of the normalizing furnace, which realizes the furnace pressure distribution mode of the present invention. By adjusting the $N_2$ supply ratio (the ratio of $N_2$ supply at the tunnel seal ($Nm^3$/hr)/total $N_2$ supply at multiple subsequent normalizing treatment furnace sections ($Nm^3$/hr)) to 1.3, Example 1 forms a protective curtain effectively cut off by $N_2$ in the tunnel seal and realizes the furnace pressure distribution mode of the present invention, so there is no oxide residue on the normalized substrate after acid pickling. The benchmark for furnace pressure control is set at 20 Pa so as to realize the stable control of furnace pressure.

In Example 2, the $N_2$ supply ratio (the ratio of $N_2$ supply at the tunnel seal ($Nm^3$/hr)/total $N_2$ supply at multiple subsequent normalizing treatment furnace sections ($Nm^3$/hr)) is set at 1.35. The furnace pressure difference between the downstream furnace section adjacent to the tunnel seal along the running direction of the strip steel and the non-oxidation heating section is 7 Pa. The slope $K'_{outlet\ direction}$ of furnace pressure reduction from the downstream furnace section adjacent to the tunnel seal along the running direction of the strip steel to the furnace sections toward the outlet of the normalizing furnace is −0.15; the slope $K_{inlet\ direction}$ of furnace pressure reduction from the non-oxidation heating section to the furnace sections toward the inlet of the normalizing furnace is 0.80. It can be seen from the above data that, the furnace pressure reaches its maximum at the downstream furnace section adjacent to the tunnel seal along the running direction of the strip steel, the furnace pressure gradually declines from the furnace section having the maximum pressure to the furnace sections toward the inlet of the normalizing furnace, and gradually declines from the furnace section having the maximum pressure to the furnace sections toward the outlet of the normalizing furnace, which realizes the furnace pressure distribution mode of the present invention. By adjusting the $N_2$ supply ratio (the ratio of $N_2$ supply at the tunnel seal ($Nm^3$/hr)/total $N_2$ supply at multiple subsequent normalizing treatment furnace sections ($Nm^3$/hr)) to 1.35, Example 2 forms a protective curtain effectively cut off by $N_2$ in the tunnel seal and realizes the furnace pressure distribution mode of the present invention, so there is no oxide residue on the normalized substrate after acid pickling. The benchmark for furnace pressure control is set at 15 Pa to realize the stable control of furnace pressure.

In Comparative Example 1, the $N_2$ supply ratio (the ratio of $N_2$ supply at the tunnel seal ($Nm^3$/hr)/total $N_2$ supply at multiple subsequent normalizing treatment furnace sections ($Nm^3$/hr)) is set at 1.15. The furnace pressure difference between the downstream furnace section adjacent to the tunnel seal along the running direction of the strip steel and the non-oxidation heating section is −5 Pa. It can be seen from the above data that, the furnace pressure reaches its maximum at the non-oxidation heating section, so the furnace pressure distribution of the present invention is not realized. Given that the $N_2$ supply ratio (the ratio of $N_2$ supply at the tunnel seal ($Nm^3$/hr)/total $N_2$ supply at multiple subsequent normalizing treatment furnace sections ($Nm^3$/hr)) is less than 1.2, neither can a protective curtain effectively cut off by $N_2$ be formed in the tunnel seal, nor can the furnace pressure distribution mode of the present invention be realized, so the backward flow of smoke occurs, and there are oxide residues on the normalized substrate after acid pickling.

In Comparative Example 2, the $N_2$ supply ratio (the ratio of $N_2$ supply at the tunnel seal ($Nm^3$/hr)/total $N_2$ supply at multiple subsequent normalizing treatment furnace sections ($Nm^3$/hr)) is set at 1.1. The furnace pressure difference between the downstream furnace section adjacent to the tunnel seal along the running direction of the strip steel and the non-oxidation heating section is −4 Pa. It can be seen from the above data that, the furnace pressure reaches its maximum at the non-oxidation heating section, so the furnace pressure distribution of the present invention is not realized. Given that the $N_2$ supply ratio (the ratio of $N_2$ supply at the tunnel seal ($Nm^3$/hr)/total $N_2$ supply at multiple subsequent normalizing treatment furnace sections ($Nm^3$/hr)) is less than 1.2, neither can a protective curtain effectively cut off by $N_2$ be formed in the tunnel seal, nor can the furnace pressure distribution mode of the present invention be realized, so the backward flow of smoke occurs, and there are oxide residues on the normalized substrate after acid pickling.

In Comparative Example 1, FIG. 3 provides the change tendency chart of both dew point and oxygen content detected in subsequent furnace sections of the tunnel seal of the normalizing furnace when the smoke of the non-oxidation heating section flows backward into the tunnel seal, and in this course, hardly removable oxides are present on the strip steel surface of normalized substrate produced after acid pickling. Dew point refers to the water content of smoke.

INDUSTRIAL APPLICABILITY

The method of producing a high quality normalized silicon steel substrate of the present invention can successfully prevent the formation of dense oxides in the normalizing treatment process, and improve the quality of normalized silicon steel substrate. By the method of the present invention, the steps following normalizing are simplified and the cost is reduced, and it can be used for the large-scale production of high-quality normalized silicon steel substrate.

The invention claimed is:

1. A method for producing normalized silicon steel substrates, comprising steps of steelmaking, hot rolling, and normalizing, wherein a normalizing furnace is used in the normalizing step and comprises sequentially, along the running direction of the strip steel, preheating section, non-oxidation heating section, tunnel seal, multiple subsequent normalizing treatment furnace sections, and exit sealing device, wherein the normalizing furnace has a pressure distribution as follows: the furnace pressure reaches its maximum at the downstream furnace section adjacent to the tunnel seal along the running direction of the strip steel, said furnace pressure gradually declines from the furnace section having the maximum pressure to the furnace sections toward the inlet of the normalizing furnace, and gradually declines from the furnace section having the maximum pressure to the furnace sections toward the outlet of the normalizing furnace.

2. The method of claim 1, wherein said multiple subsequent normalizing treatment furnace sections include at least one furnace section selected from the group consisting of radiant tube heating/cooling section, electric/radiant tube soaking section, and radiant tube/water jacket cooling section, and wherein said multiple subsequent normalizing treatment furnace sections are arranged in a random sequence.

3. The method of claim 1, wherein protective gas of $N_2$ is charged into the furnace sections between tunnel seal and exit sealing device, and a supply of the protective gas of $N_2$ to the furnace sections between the tunnel seal and exit sealing device is adjusted so as to realize said distribution of furnace pressure.

4. The method of claim 3, wherein the supply of the protective gas of $N_2$ to said furnace sections satisfies the following relation:

$N_2$ supply at tunnel seal/total $N_2$ supply at multiple subsequent normalizing treatment furnace sections$\geq$1.2.

5. The method of claim 1, wherein said distribution of furnace pressure has a furnace pressure difference controlled in the range from 0 to 10 Pa between the downstream furnace section adjacent to the tunnel seal along the running direction of the strip steel and the non-oxidation heating section.

6. The method of claim 5, wherein said furnace pressure difference is controlled in the range from 5 to 10 Pa.

7. The method of claim 1, wherein said distribution of furnace pressure has a benchmark for furnace pressure control set in the range from 10 to 25 Pa.

8. The method of claim 1, wherein in said distribution of furnace pressure, the slope of furnace pressure reduction from the downstream furnace section adjacent to the tunnel seal along the running direction of the strip steel to the furnace sections toward the outlet of the normalizing furnace is between −0.05 and −0.25, and wherein the slope of furnace pressure reduction from the non-oxidation heating section to the furnace sections toward the inlet of the normalizing furnace is between 0.55 and 0.8.

* * * * *